US006784148B2

(12) United States Patent
Tadrowski et al.

(10) Patent No.: US 6,784,148 B2
(45) Date of Patent: Aug. 31, 2004

(54) SPRAYABLE HARD SURFACE CLEANER AND METHOD OF USE

(75) Inventors: Tami Jo Tadrowski, Greensboro, NC (US); Karen Odom Rigley, Greensboro, NC (US)

(73) Assignee: Kay Chemical, Inc, Greensboro, NC (US)

( * ) Notice: Subject to any disclaimer, the term of this patent is extended or adjusted under 35 U.S.C. 154(b) by 0 days.

(21) Appl. No.: 09/837,398

(22) Filed: Apr. 18, 2001

(65) Prior Publication Data

US 2003/0022804 A1 Jan. 30, 2003

(51) Int. Cl.[7] ..... C11D 17/00

(52) U.S. Cl. ..... 510/197; 510/218; 510/219; 510/426; 510/491; 510/512

(58) Field of Search ..... 510/218, 219, 510/197, 426, 491, 512

(56) References Cited

U.S. PATENT DOCUMENTS

| | | | | |
|---|---|---|---|---|
| 5,047,167 A | * | 9/1991 | Steyn et al. | 252/160 |
| 5,565,419 A | | 10/1996 | Thomas et al. | 510/197 |
| 5,972,866 A | | 10/1999 | Ahmed | 510/218 |
| 5,981,457 A | | 11/1999 | Ahmed | 510/223 |

* cited by examiner

*Primary Examiner*—Necholus Ogden
(74) *Attorney, Agent, or Firm*—Withers & Keys, LLC

(57) ABSTRACT

The present invention is a non-corrosive, low-fuming oven cleaning composition that can be used easily on vertical oven surfaces. The present invention is a cleaning composition containing a tripolyphosphate and a thickening agent to promote in adherence to vertical surfaces.

35 Claims, No Drawings

SPRAYABLE HARD SURFACE CLEANER AND METHOD OF USE

FIELD OF THE INVENTION

The invention relates to the cleaning of hard surfaces with non-corrosive, low-fuming compositions. More particularly, the invention relates to non-corrosive, low-fuming oven cleaning compositions. Still more particularly, the present invention relates to a method of cleaning vertical surfaces with a non-corrosive, low-fuming composition.

BACKGROUND OF THE INVENTION

During food preparation, the use of ovens both at home and in commercial kitchens are standard. Depending upon the cooking process, food may be cooked directly on the oven surface or it may be placed within the oven in a container during cooking. In both processes food products contact and inevitably get baked on to the oven surface. This baked on soil becomes even more difficult to clean if it is allowed to build up during successive heating cycles within the oven.

To clean these difficult soils, prior art cleaners rely heavily upon caustic components to achieve sufficient cleaning. The use of caustic components, while being effective to remove tough soils, results in compositions that may not be safe for the end-user.

To address these safety issues, non-corrosive alternatives to these cleaners have been developed. Commercially available non-corrosive products are also available as fume free products. However, prior art non-corrosive products, such as the prior art fume free products, generally provide cleaning which is inferior to the cleaning that can be achieved with corrosive oven cleaning products. Furthermore, while claiming to be fume free, prior art fume free products often must be used at ambient temperature to avoid fumes that may be produced at higher temperatures Accordingly, even "fume free" products may produce fumes that are irritating to the user of the product.

The present invention overcomes these disadvantages associated with the prior art, by providing a low-fuming, non-corrosive, low caustic level cleaner that can be used to efficiently remove baked on soils. The composition of the present invention can be used easily on the vertical wall surfaces of an oven either at ambient or elevated temperatures.

SUMMARY OF THE INVENTION

In accordance with one aspect of the invention there is provided a method of cleaning a food surface by applying a non-corrosive low-fuming composition to the surface. The composition includes a detergent builder, an alkalinity source to provide a compositional pH of from about 10 to 14, a thickening agent to promote thickening and adhesion of the non-corrosive, low-fuming composition to the surface upon application, and a balance of water. The composition is substantially free of chlorinated products.

In accordance with a further aspect of the invention, there is provided a thickened oven cleaning composition comprising a detergent builder, a thickening agent to provide increased viscosity, a source of alkalinity to provide a compositional pH of about 10 to 14, a surfactant to provide detergency to the composition, and a balance of water.

In accordance with an alternative aspect of the invention, there is provided a method of cleaning a substantially vertical surface with an adherent, thickened, low-fuming, non-corrosive composition. The method comprises applying the composition to the substantially vertical surface. The composition includes from about 0.1 wt-% to about 20.0 wt-% of a detergent builder, from about 0.1 wt-% to about 5 wt-% of a thickener, from about 0.1 wt-% to about 20 wt-% of an alkali source providing a compositional pH of greater than about 10, and a balance of water. The composition has a Brookfield viscosity ranging from about 30 to 10,000 Cps at 25° C. Brookfield viscosity refers to an art recognized measurement method with the viscosity being measured using an appropriate spindle and speed to obtain optimum accuracy. Upon application, at least about 75 wt-% of the applied cleaner adheres to the surface of application for at least about 30 minutes.

The invention includes methods and composition for cleaning oven surfaces. The invention provides a sprayable, adherent, non-corrosive, low-fuming cleaning composition. The invention provides a composition which is adherent to the surface of application even when positioned substantially vertically. Up to about 75 wt-%, preferably up to about 85 wt-% and most preferably up to about 95 wt-% of the applied composition may be retained on the surface of application after about 30 minutes at ambient temperatures, when the surface is held substantially vertically.

The methods and compositions of the invention are also non-corrosive, providing less than about 250 mils/year of steel reduction, in accordance with United States Department of Transportation Hazardous Material Regulation 173.136.

The compositions of the present invention are also non-corrosive to eyes of the user. Non-corrosive to the eyes refers to compositions that do not cause permanent corneal damage when evaluated according to the scale for scoring occular lesions in Draize et al., Method for the study of irritation and toxicity of substance applied topically to the skin and mucous membranes, J. Pharmacol. Exp. Ther. 1944, 82:377–390.

The present invention is also low-fuming. Low-fuming is described as used in the present invention refers to a product that produces little or no substantial fumes when applied to the surface of interest at the temperature of interest. Fume levels can be evaluated subjectively by noting the level of smell and irritants given off by the product upon application.

Fume levels may also be evaluated using head space GC analysis. GC analysis provides a quantitative amount of the chemical released that are considered to be inhalation irritants. Alternatively, fume levels can be measured using vapor pressure droplet size evaporation.

Preferred compositions according to the present invention exhibit few fumes at temperatures in excess of 100° F., more preferably in excess of 150° F., most preferably in excess of 200° F.

According to one embodiment of the present invention, the compositions are substantially free of chlorine. As used herein, the term "substantially free of chlorine" refers to a composition that has insufficient chlorine to have any irritating effects. More particularly, "substantially free of chlorine" refers to a composition containing less than 0.1% chlorine.

DETAILED DESCRIPTION OF THE INVENTION

The invention includes methods and compositions for cleaning surfaces, preferably food cooking surfaces. According to the invention, a thickened, non-corrosive low-fuming composition is applied to the intended surface. The thickened composition includes a detergent builder, preferably an anionic surfactant to provide detergency, a source of alkalinity, such as sodium hydroxide, and preferably a thickening agent to promote adhesion of the thickened, non-corrosive, low-fuming composition to the surface.

THE COMPOSITION

In accordance with the invention, the oven cleaning composition contains a detergent builder. Builders complex hardness ions such as Mg and Ca, maintain the pH of the composition and increase the efficacy of the cleaning system. Suitable builders include tripolyphosphates, salts of alkali metal borates, phosphates and carbonates and bicarbonate, and mixtures thereof.

Preferred detergent builders are selected from tripolyphosphates. One preferred tripolyphosphate which may be used with the invention is an alkali metal polyphosphate such as sodium tripolyphosphate ("STPP") or potassium tripolyphosphate ("KTPP") or a mixture thereof. The tripolyphosphate, e.g. STPP or KTPP or mixtures thereof, may be used in the composition of the invention in an amount of up to about 20 wt-%, preferably about 1 wt-% to about 15 wt-% and more preferably about 3 wt-% to about 13 wt-%.

Specific examples of other detergent builders that may be used in the oven cleaning composition of the present invention are sodium tetraborate, sodium nitrilotriacetate, sodium pyrophosphate, potassium pyrophosphate, sodium bicarbonate, sodium hexametaphosphate, sodium sesquicarbonate, sodium mono-and diorthophosphate and potassium bicarbonate, and mixtures thereof. Other useful builders also include the Dequest.RTM. product line of phosphates such as tetrasodium 1-hydroxyethylidene-1,1-diphosphonate and its acid form (Dequest.RTM. 2016 and 2010, respectively) as well as pentasodium diethylene triamine pentamethylene phosphate and its acid form (Dequest.RTM. 2066 and 2060, respectively). Also useful are phosphate compounds sold by Witco such as Emphos 10TP.

Organic builder salts may also be used according to the present invention. Since the compositions of this invention are generally highly concentrated, and, therefore, may be used at relatively low dosages, it may also be desirable to supplement any inorganic builder with an auxiliary builder such as an alkali metal polycarboxylic acid. Suitable alkali metal polycarboxylic acids are alkali metal salts of maleic and acrylic acid, and salts thereof. Also useful are alkali metal polyacrylates, and polyacrylate-maleate copolymers, (e.g. sodium polyacrylate-maleic copolymers). When used, organic builders may be present in a concentration ranging from 0.1 wt-% to 10 wt-%, preferably from 2 wt-% to 8 wt-%, and more preferably from 3 wt-% to 6 wt-% based on the composition as a whole.

The composition of the invention may also comprise a metal ion chelating composition. Preferred chelators include, but are not limited to, sodium gluconate, gluconic acid, sorbitol, citric acid, aminoalkyl phonic acid, lauryl ethylene diamine triacetic acid, potassium gluconate, sodium-α-d-glucoheptonate dihydrate, tetrasodium salt of EDTA, polyacrylic acid, and sodium polyacrylates, as well as other art recognized metal ion chelating agents. Chelators are present in an amount of from about 0.0 wt-% to about 2.0 wt-%, more preferably from about 0.25 wt-% to about 1 wt-%, most preferably from about 0.25 wt-% to about 0.5 wt-%.

The composition of the invention may also comprise a thickener. For products formulated to be used on vertical surfaces, a thickener component will be included. One or more thickeners or suspending agents can be used in accordance with the invention to provide the aqueous medium with thickened properties. Preferred thickeners for use with the present invention result in a product that is sprayable and foamable. [Desirably, the sprayable product has a Brookfield viscosity ranging from about 30 to about 300 cps, more desirably, from about 30 to about 100 cps, and even more desirably, from about 50 to about 70 cps.] Organic polymeric thickeners and inorganic colloid forming clay materials are examples of those thickeners which may be used. The thickeners should be stable in high alkalinity.

Organic polymeric thickeners include polycarboxylate polymers having a molecular weight from about 500,000 to about 4,000,000, preferably from about 1,000,000 to about 4,000,000, with, preferably, from about 0.5% to about 4% crosslinking. The preferred polymers are polycarboxylate polymers. Preferred polycarboxylate polymers include polyacrylate polymers including those sold under trade names Carbopol.RTM., Acrysol.RTM. ICS-1 and Sokalan.RTM. Other monomers besides acrylic acid can be used to form these polymers including such monomers as ethylene and propylene which act as diluents, and maleic anhydride which acts as a source of additional carboxylic groups.

The molecular weight and level of polycarboxylic polymer may be adjusted to give the desired product stability at the proper viscosity. The typical range of polycarboxylate polymer is from about 0.1 wt-% to about 3 wt-%, preferably from about 0.2 wt-% to about 2 wt-%, more preferably from about 0.5 wt-% to about 1 wt-% of the composition.

Other useful thickeners comprise colloid-forming clays, for example, such as smectite and/or attapulgite types.

The clay materials which function in the instant composition as thickening and corrosion protection agents can be described as expandable layered clays, i.e., aluminosilicates and magnesium silicates. The term "expandable" as used to describe the instant clays relates to the ability of the layered clay structure to be swollen, or expanded, on contact with water. The expandable clays used herein are those materials classified geologically as smectites (or montmorillonite) and attapulgites (or polygorskites).

Smectites are three-layered clays. There are two distinct classes of smectite-type clays. In the first, aluminum oxide is present in the silicate crystal lattice; in the second class of smectites, magnesium oxide is present in the silicate crystal lattice. The general formulas of these smectites are $Al_2(Si_2O_5)_2(OH)_2$ and $Mg_3(Si_2O_5)(OH)_2$, for the aluminum and magnesium oxide type clays, respectively. It is to be recognized that the range of the water of hydration in the above formulas may vary with the processing to which the clay has been subjected.

Commercially available clays include, for example, montmorillonite (bentonite), volchonskoite, nontronite, beidellite, hectorite, saponite, sauconite and vermiculite. The clays herein are available under various trade names such as Thixogel No. 1 and Gelwhite GP from Georgia Kaolin Company, Elizabeth, N.J. (both montmorillonites); Volclay BC and Volclay No. 325, from American Colloid Company, Skokie, Ill.; Black Hills Bentonite BH 450, from International Minerals and Chemicals; Veegum Pro and Veegum F, from R.T. Vanderbilt (both hectorites); Barasym NAS-100, Barasym NAH-100, Barasym SMM 200, and Barasym LIH-200, all synthetic hectorites and saponites marketed by Baroid Division, NL Industries, Inc.

A second type of expandable clay material useful in the instant invention is classified geologically as attapulgite (polygorskite). Attapulgites are magnesium-rich clays having principles of superposition of tetrahedral and octahedral unit cell elements different from the smectites.

A typical attapulgite analyses yields 55.02% SiO2; 10.24% Al2O3; 3.53% Fe2O3; 10.45% MgO; 0.47% $K_2O$; with 9.73% $H_2O$ removed at 150° C. and 10.13% $H_2O$ removed at higher temperatures.

Like the smectites, attapulgite clays are commercially available. For example, such clays are marketed under the tradename Attagel, i.e. Attagel 40, Attagel 50 and Attagel 150 from Engelhard Minerals & Chemicals Corporation.

Useful clay thickeners comprise the inorganic, colloid forming clays of smectite and/or attapulgite types. Preferred clays include products from Vanderbilt Chemical Company such as VanGel O®. Clay thickeners may be used in amounts of about 0.1 wt-% to 5 wt-%, preferably 0.5 wt-% to 4 wt-% and more preferably 0.5 wt-% to 3 wt-%.

Generally, the composition of the invention may also comprise a surfactant. Preferably, the surfactant is stable in the presence of high alkalinity. Generally, anionic surfactants are preferred for use in the composition of the invention although certain other surfactants may be used. The anionic surfactants provide detergency and may increase viscosity. Further, the surfactants hydrate and stabilize the inorganic thickening agent.

Exemplary anionic surfactants which are suitable for the compositions of the invention include, but are not limited to, water soluble alkyl and alkyl ether sulfates and sulfonates, containing from about 8 to about 18 carbon atoms.

Specific examples of sulfate salts which can be employed in the compositions of the invention include sodium or potassium lauryl sulfate, sodium or potassium octyl sulfate, sodium or potassium stearyl sulfate, sodium or potassium palmityl sulfate, sodium or potassium decyl sulfate, sodium or potassium myristyl sulfate, potassium dodecyl sulfate, sodium or potassium tallow sulfate, sodium or potassium coconut sulfate, magnesium coconut sulfate, calcium coconut sulfate, and mixtures thereof.

Sulphonated surfactants are also useful in the invention including alkyl, aryl, and alkyl/aryl sulphonates such as alkali metal $C_{10}$–$C_{18}$ alkyl/aryl sulphonates such as sodium alkyl benzene sulphonates and sodium dodecyl benzene sulphonate. Also useful are alpha-olefin sulphonates, alkyl naphthalene sodium sulphonates and the like. A useful sulfonated anionic surfactant is the alkali metal salt of secondary alkane sulfonates, an example of which is the Hostapur SAS from Hoechst Celanese.

Certain surfactants which are not anionic may also be used such as amine oxides like alkyl $C_{12-16}$ dimethyl amine oxide, decyldimethyl amine oxide, and octadecyl dimethyl amine oxide available as Barlox 12, 10S and 18S, respectively; and carboxylate compounds such as Emcol CBA 50 from Witco (trideceth-7 carboxylic acid).

Preferably, anionic linear or branched alkyl ether sulphonates are used such as those available from Dow Chemical Co. as Dow Fax.RTM. 3B-2, 2A-1, and C6L. These surfactants may be either mono or di-alkyl as well as mono or di-sulphonate. Generally, the surfactant may be used at a concentration of about 0 wt-% to about 5 wt-%, preferably about 0.5 wt-% to about 3 wt-%, and more preferably about 0.5 wt-% to about 2 wt-% of the composition as a whole.

Optionally, the composition of the invention may also comprise a stabilizing agent useful in maintaining a homogeneous mixture of detergent builder, thickening agent, and alkali source. One preferred class of stabilizing agents includes fatty acids such as the higher aliphatic fatty monocarboxylic acids having from about 10 to about 40 carbon atoms, more preferably from about 10 to 30 carbon atoms, and especially preferably from about 12 to 18 carbon atoms, inclusive of the carbon atom of the carboxyl group of the fatty acid.

The aliphatic radicals are saturated and can be straight or branched. Straight chain saturated fatty acids are preferred. Mixtures of fatty acids may be used, such as those derived from natural sources, such as stearic fatty acid, tallow fatty acid, coco fatty acid, soya fatty acid, etc., or from synthetic sources available from industrial manufacturing processes. The fatty acids are preferably fully saturated. Preferably, the fatty acid used has a low iodine value, that is less than about 2, and preferably less than about 1.

Examples of the fatty acids which may be used in the invention include, for example, decanoic acid, lauric acid, dodecanoic acid, palmitic acid, myristic acid, stearic acid, oleic acid, cicosanoic acid, tallow fatty acid, coco fatty acid, soya fatty acid and mixtures of these acids. Stearic acid mixed with palmitic acid available in the Industrene product line from Witco is generally preferred.

Generally, the amounts of the fatty acid stabilizer that may be used are in the range of from about 0.05 to 5 wt-%, preferably from about 0.1 to 4 wt-%, especially preferably from about 0.5 to 2 wt-%, provide the desired long term stability and absence of phase separation.

In order to provide an alkaline pH, the composition comprises an alkalinity source. The alkalinity source may be used up to levels that would be below extremely irritating to the eyes. Generally, the alkalinity source raises the pH of the composition to at least about 10, generally to a range from about 10 to 14, preferably from about 11 to 14, and most preferably from about 12 to 13.5.

This higher pH increases the efficacy of the soil removal and sediment breakdown when the chemical is placed in use and further facilitates the rapid dispersion of soils. The general character of the alkalinity source is limited only to those chemical compositions which have a greater solubility. That is, the alkalinity source should not contribute metal ions which promote the formation of precipitates or film salts. Exemplary alkalinity sources include silicates, hydroxides, phosphates, and carbonates.

Silicates useful with this invention include alkali metal ortho-, meta-, di-, tri-, and tetrasilicates such as sodium orthosilicate, sodium sesquisilicate, sodium sesquisilicate pentahydrate, sodium metasilicate, sodium metasilicate pentahydrate, sodium metasilicate hexahydrate, sodium metasilicate octahydrate, sodium metasilicate nanohydrate, sodium disilicate, sodium trisilicate, sodium tetrasilicate, potassium metasilicate, potassium metasilicate hemihydrate, potassium silicate monohydrate, potassium disilicate, potassium disilicate monhydrate, potassium tetrasilicate, potassium tetrasilicate monohydrate, or mixtures thereof.

Generally, when a silicate compound is used as the alkalinity source in the invention, the concentration of the silicate will range from about 0.1 wt-% to 14 wt-%, preferably from about 1 wt-% to 12 wt-%, and most preferably from about 2 wt-% to 10 wt-%.

Alkali metal hydroxides have also been found useful as an alkalinity source in the invention. Alkali metal hydroxides are generally exemplified by species such as potassium hydroxide, sodium hydroxide, lithium hydroxide, and the like. Mixtures of these hydroxide species may also be used.

While present, the alkaline hydroxide concentration generally ranges from about 0.1 wt-% to about 3 wt-%, preferably from about 0.8 wt-% to 2.5 wt-%, and most preferably from about 1 wt-% to 2 wt-%.

An additional source of alkalinity includes carbonates. Alkali metal carbonates which may be used in the invention include sodium carbonate, potassium carbonate, sodium or potassium bicarbonate or sesquicarbonate, among others. Preferred carbonates include sodium and potassium carbonates. When carbonates are used the concentration of these agents generally ranges from about 0.1 wt-% to 20 wt-%, preferably from about 1 wt-% to 15 wt-% and most preferably from about 4 wt-% to 10 wt-%.

Phosphates which may be used as an alkalinity source in accordance with the invention include cyclic phosphates such as sodium or potassium orthophosphate, alkaline condensed phosphates such as sodium or potassium pyrophosphate, sodium hexametaphosphate, and the like. When phosphates are used the concentration will generally range from 0.1 wt-% to 20 wt-%, preferably from 1 wt-% to 15 wt-%, and most preferably 3 wt-% to 13 wt-%.

Dyes can be used in the formulation according to the present invention to impart any color which may be desired. Appropriate dyes will be readily apparent to the skilled artisan. Preferred dyes include Pylaklor dark violet LX-10619 available from Pylon Products Co., Inc. The amount of dye used will be based upon the dye intensity and the desired result. Appropriate amounts of dye would be readily apparent to the skilled artisan.

A summary of the concentration ranges for the composition of the invention may be found in Table 1.

TABLE 1

(wt - %)

| | Useful | Preferred | More Preferred |
|---|---|---|---|
| Thickener | 0.1–5 | 0.2–3 | 0.5–2 |
| Detergent Builder | 0.1–20 | 1.0–15 | 3.0–13 |
| Surfactant | 0.05–5 | 0.5–3 | 0.5–2 |
| Stabilizer | 0.05–5 | 0.1–4 | 0.5–2 |
| Alkali Source | 0.1–20 | 0.5–15 | 1.0–10 |
| Metal Ion Chelator | 0.1–2 | 0.25–1 | 0.25–0.5 |
| Water | Balance | Balance | Balance |
| pH | 10–14 | 11–14 | 12–13.5 |

Formulation and Application

The thickened non-corrosive, low-fuming composition of the invention may be prepared by any means known to those of ordinary skill in the art. Generally, water and, if used, the optional thickener are added to a mixing vessel and mixed for a period of time sufficient to provide a homogenous mixture, about 2.5 to 3 hours. These constituents may be added slowly by screening to ensure complete dissolution. Once homogenous, a detergent builder is added to the system with continued mixing up to about 3 hours. Appropriate testing may be done to ensure the necessary presence of all constituents, for example, tripolyphosphate and thickener.

Once formulated, the composition of the invention may be applied to any food surface having baked on soils to facilitate cleaning. Desirably, the composition of the present invention is applied to a surface by spraying the composition. After application for a time period ranging from about 1 minute to about 3 hours, the composition of the invention may be wiped or rinsed from the surface of application. The invention may be used on surfaces and food preparation equipment made of metal comprised of metal alloys, and enameled surfaces. The composition and methods of the invention may also be used on any other surfaces, including vertical or substantially vertical surfaces in any environment requiring cleaning of baked on soils.

WORKING EXAMPLES

The following examples illustrate the characteristics and properties of the invention. However, these examples do not limit the invention. The invention is limited only by the claims appended to this specification.

Example 1

A cleaner was formulated according to the invention, to determine the cleaning properties of the system. A master batch was formulated first.

| | Constituent | Wt - % |
|---|---|---|
| Master Batch | Water | 84.6 |
| | Carbopol 672 (thickener) | 0.2 |
| | NaOH (50%) | 3.0 |
| | Stearic acid | 0.7 |
| | Sodium Tripolyphosphate | 10.00 |
| | Dowfax 3B2 (anionic surfactant) | 1.5 |

Carbopol was slowly added to the water by screening. The mixture was agitated and mixed for 2.5 hours. Sodium Tripolyphosphate was slowly added to the mixture by screening. The agitator speed is adjusted as the mixture thickens. Stearic acid was added. The Dowfax 3B2 was added to the mixture and stirring was continued only until it was blended. NaOH was added and the mixture was agitated.

The oven cleaning composition was tested on caramelized soil on stainless steel. At 190° F., the composition exhibited excellent cleaning.

Example 2

Example 2 was formulated in the same manner as Example 1.

| | Constituent | Wt - % |
|---|---|---|
| Master Batch | Water | 84.17 |
| | KelzanAR (thickener) | 0.325 |
| | NaOH | 2.00 |
| | Polystep B29 | 2.0 |
| | Sodium Tripolyphosphate | 10.00 |
| | Dowfax 3B2 (anionic surfactant) | 1.5 |
| | Purple dye | 0.002 |

The composition was produced in the same manner as Example 1. The Polystep B29 was added after the Dowfax 3B2 with agitation only until just blended. The violet dye was added after the formulation was complete.

Example 3

| | Constituent | Wt - % |
|---|---|---|
| Master Batch | Water | 83.05 |
| | Carbopol 980 (thickener) | 0.80 |
| | NaOH (50%) | 2.35 |
| | Na Gluconate | 0.25 |
| | Sodium Tripolyphosphate | 10.00 |
| | Dowfax 3B2 (anionic surfactant) | 1.5 |
| | Polystep B29 | 2.0 |
| | Purple LX (dye) | 0.0005 |

Carbopol was slowly added to the water by screening. The mixture was agitated and mixed for 2.5 hours. Sodium Tripolyphosphate was slowly added to the mixture by screening. The agitator speed is adjusted as the mixture thickens. Sodium Gluconate was added. The Dowfax 3B2 and Polystep B29 were added to the mixture and stirring was continued only until it was blended. NaOH was added and the mixture was agitated. Dye was added and the mixture was mixed for 10 minutes.

The oven cleaning composition was tested on caramelized soil on stainless steel. At 190° F., the composition exhibited excellent cleaning.

Example 4

The cleaner of the present invention prepared in the same manner as Example 2, was compared to both corrosive and non-corrosive products. The results are set forth in Table 1, below.

TABLE 1

Oven Cleaner Performance

| Substrate | Contact Time | Surface Temperature | Oven Cleaner of the Present Invention* | Proprietary Fryer & Oven Cleaner | Proprietary Inside/Outside Degreaser* | Commercially available Fume Free* | Commercially available Heavy Duty | Alkali Oven Cleaner |
|---|---|---|---|---|---|---|---|---|
| Moderately Carbonized Stainless Steel Panel | 3 Hours | Ambient | Approx. 90% Soil Removal | 100% Soil Removal | Approx. 5–10% Soil Removal | Approx. 15% Soil Removal | 100% Soil Removal | Approx. 50% Soil Removal |
| Moderately Carbonized Stainless Steel Panel | 15 Minutes | 200° F. | >95% Soil Removal | >95% Soil Removal | No Soil Removal | NA | 100% Soil Removal | Approx. 70% Soil Removal |
| Moderately Carbonized Stainless Steel Panel | 20 Minutes | 110° F. | 100% Soil Removal | 100% Soil Removal | Approx. 1–2% Soil Removal | NA | 100% Soil Removal | 100% Soil Removal |
| Moderately Carbonized Stainless Steel Panel | 10 Minutes | 325° F. | 100% Soil Removal | 100% Soil Removal | Approx. 10% Soil Removal | NA | 100% Soil Removal | >95% Soil Removal |
| Lightly Carbonized Stainless Steel | 15 Minutes | Ambient | Approx. 5% Soil Removal | Approx. 90–95% Soil Removal | No Soil Removal | No Soil Removal | >95% Soil Removal | Approx. 70% Soil Removal |

*Non-corrosive Formulas

Examples 5–9

The following examples were prepared as described in Example 1. The amounts of the various components are noted in Table 2, below.

TABLE 2

| Example No. | Carbopol thickener | NaOH | STPP | Stearic Acid | Dowfax 3B2 | Water | Veegum | Polystep B29 |
|---|---|---|---|---|---|---|---|---|
| 5 | 0.2 | 3.0 | 10.0 | 0.7 | 1.5 | 84.6 | — | — |
| 6 | — | 2.0 | 10.0 | — | 1.5 | 83. | 3.0 | — |
| 7 | — | 2.0 | 10.0 | — | 1.5 | 81.5 | 3.0 | 2.0 |
| 8 | 0.2 | 2.0 | 10.0 | — | 1.5 | 84.3 | — | 2.0 |
| 9 | 0.5 | 2.0 | 10.0 | 0.5 | 1.5 | 83.5 | — | 2.0 |

Veegum is a magnesium aluminum silicate thickener. In examples using Veegum, the addition order was varied to establish the best possible mixture.

The above specification, examples and data provide a complete description of the manufacture and use of the composition of the invention. Since many embodiments of the invention can be made without departing from the spirit and scope of the invention, the invention resides in the claims hereinafter appended.

The claimed invention is:

1. A method of cleaning a hard surface, said method comprising:

spraying a non-corrosive, low-fuming composition having a viscosity ranging from about 30 to about 70 Cps at 25° C. onto the surface, said composition comprising:

(a) from about 3.0 wt-% to about 20.0 wt-% of at least one detergent builder selected from tripolyphosphates;

(b) from about 0.1 wt-% to about 20 wt-% of an alkalinity source effective to provide a pH of from about 10 to about 14 to said composition;

c) from about 0.0 wt-% to about 5.0 wt-% of at least one thickening agent to promote adhesion of said thickened, non-corrosive composition to the surface upon application;

d) from about 0.0 wt-% to about 5 wt-% of fatty acid stabilizer to maintain a homogenous mixture of said at least one detergent builder, at least one thickening agent, and alkalinity source;

e) from about 0.0 wt-% to about 5.0 wt-% of an anionic surfactant effective to provide detergency to the thickened, non-corrosive low-fuming composition said anionic surfactant selected from the group consisting of an alkyl sulfate, an alkyl sulfonate, a disulphonate compound, an alkyl ether sulfate, an alkyl ether sulfonate, an alkyl aryl sulfonate, and mixtures thereof;

(f) from about 0.0 wt-% to about 2.0 wt-% of a metal ion chelator; and (g) a balance of water;

wherein the composition is substantially free of chlorine.

2. The method of claim 1, wherein said surface is substantially vertical, and wherein said composition contains at least 0.1 wt-% of at least one thickening agent.

3. The method of claim 2, wherein upon application of said non-corrosive composition to the substantially vertical surface at least about 75 wt-% of the applied non-corrosive low-fuming composition adheres to the surface for a time period up to about 30 minutes.

4. The method of claim 1, wherein said thickening agent comprises one or more polycarboxylate polymers.

5. The method of claim 1, wherein the at least one detergent builder is sodium tripolyphosphate.

6. The method of claim 1, wherein said alkalinity source is an alkali metal hydroxide and is present in an amount of from about 0.1 wt-% to about 3 wt-%.

7. The method of claim 1, wherein said composition includes at least 0.1 wt-% of a metal ion chelator.

8. A sprayable thickened hard surface cleaning composition comprising:

(a) from about 0.1 wt-% to about 20.0 wt-% of at least one detergent builder selected from tripolyphosphates; salts of alkali metal borates, phosphates, carbonates and bicarbonates; and mixtures thereof;

(b) from about 0.1 wt-% to about 5 wt-% of at least one thickening agent effective to provide increased viscosity;

(c) from about 0.1 wt-% to about 3.0 wt-% of an alkali metal hydroxide to provide a pH of about 10 to about 14;

(d) from about 0.5 wt-% to about 5.0 wt-% of an anionic surfactant to provide detergency to the composition;

(e) from about 0.0 wt-% to about 5 wt-% of a fatty acid stabilizer effective to maintain a homogenous mixture of said at least one detergent builder, at least one thickening agent, and alkali metal hydroxide;

(f) from about 0.0 wt-% to about 2.0 wt-% of a metal ion chelator; and (g) a balance of water;

wherein said composition is substantially free of chlorine and has a viscosity ranging from about 30 to about 70 Cps. at 25° C.

9. The composition of claim 8, wherein said composition has a pH of about 12 to about 13.5.

10. The composition of claim 8, wherein said composition comprises from about 0.1 wt-% to 3.0 wt-% of an alkali metal hydroxide and the pH of said composition is greater than about 11.

11. The composition of claim 8, wherein said composition comprises:

(a) from about 1.0 wt-% to about 20.0 wt-% of an alkali metal tripolyphosphate;

(b) from about 0.1 wt-% to about 3.0 wt-% of sodium hydroxide.

12. The composition of claim 11, wherein said alkali metal tripolyphosphate comprises sodium tripolyphosphate.

13. A method of cleaning a hard surface, said method comprising:

applying a sprayable non-corrosive, low-fuming composition having a viscosity ranging from about 30 to about 70 Cps at 25° C. to the surface, said composition consisting essentially of:

(a) from about 0.1 wt-% to about 20.0 wt-% of at least one detergent builder selected from tripolyphosphates; salts of alkali metal borates, phosphates, carbonates and bicarbonates; and mixtures thereof;

(b) from about 0.1 wt-% to about 20 wt-% of an alkalinity source effective to provide a pH of from about 10 to about 14 to said composition;

(c) from about 0.0 wt-% to about 5.0 wt-% of at least one thickening agent to promote adhesion of said thickened, non-corrosive composition to the surface upon application;

(d) from about 0.5 wt-% to about 5.0 wt-% of an anionic surfactant effective to provide detergency to the thickened, non-corrosive low-fuming composition said anionic surfactant selected from the group consisting of an alkyl sulfate, an alkyl sulfonate, a disulphonate compound, an alkyl ether sulfate, an alkyl ether sulfonate, an alkyl aryl sulfonate, and mixtures thereof;

(e) from about 0.0 wt-% to about 2.0 wt-% of a metal ion chelator;

(f) an optional dye; and (g) water.

14. The method of claim 1, wherein said composition comprises from about 3.0 wt-% to about 13.0 wt-% of at least one detergent builder selected from tripolyphosphates.

15. The method of claim 1, wherein said composition comprises from about 0.5 wt-% to about 3.0 wt-% of an anionic surfactant.

16. The method of claim 1, wherein the anionic surfactant comprises an alkyl sulfate, an alkyl aryl sulfonate, or a mixture thereof.

17. The method of claim 1, wherein said at least one thickening agent comprises one or more expandable clays.

18. The composition of claim 8, wherein said composition comprises from about 3.0 wt-% to about 13.0 wt-% of at least one detergent builder selected from tripolyphosphates.

19. The composition of claim 8, wherein said composition comprises from about 0.5 wt-% to about 3.0 wt-% of an anionic surfactant.

20. The composition of claim 8, wherein the anionic surfactant comprises an alkyl sulfate, an alkyl aryl sulfonate, or a mixture thereof.

21. The composition of claim 8, wherein said at least one thickening agent comprises one or more expandable clays.

22. The composition of claim 8, wherein said at least one thickening agent comprises a xantham gum.

23. The composition of claim 8, wherein said composition consists essentially of:

(a) from about 0.1 wt-% to about 20.0 wt-% of at least one detergent builder selected from tripolyphosphates; salts of alkali metal borates, phosphates, carbonates and bicarbonates; and mixtures thereof;

(b) from about 0.1 wt-% to about 5 wt-% of at least one thickening agent effective to provide increased viscosity;

(c) from about 0.1 wt-% to about 3.0 wt-% of an alkali metal hydroxide to provide a pH of about 10 to about 14;

(d) from about 0.5 wt-% to about 5.0 wt-% of an anionic surfactant to provide detergency to the composition;

(e) from about 0.0 wt-% to about 2.0 wt-% of a metal ion chelator;

(f) an optional dye; and (g) water.

24. The composition of claim 23, wherein said composition consists essentially of:

(a) from about 3.0 wt-% to about 13.0 wt-% of at least one detergent builder selected from tripolyphosphates;

(b) from about 0.1 wt-% to about 5 wt-% of at least one thickening agent comprising one or more polycarboxylate polymers;

(c) from about 0.1 wt-% to about 3.0 wt-% of an alkali metal hydroxide to provide a pH of about 10 to about 14;

(d) from about 0.5 wt-% to about 5.0 wt-% of an anionic surfactant comprising an alkyl sulfate, an alkyl aryl sulfonate, or a mixture thereof;

(e) from about 0.0 wt-% to about 2.0 wt-% of a metal ion chelator;

(f) a dye; and (g) water.

25. The method of claim 13, wherein said composition contains from about 3.0 wt-% to about 13.0 wt-% of at least one detergent builder selected from sodium tripolyphosphate, potassium tripolyphosphate, or mixtures thereof; and from about 0.2 wt-% to about 5.0 wt-% of at least one thickening agent comprising (i) one or more polycarboxylate polymers, (ii) one or more expandable clays, (iii) or a mixture thereof.

26. The method of claim 13, wherein the step of applying comprises spraying the composition.

27. The method of claim 1, wherein said at least one thickening agent comprises a xantham gum.

28. The method of claim 1, wherein said composition comprises from greater than 0 wt-% to about 2.0 wt-% of a metal ion chelator, said metal ion chelator consisting of sodium gluconate.

29. The method of claim 1, wherein said composition consists essentially of:

(a) from about 0.1 wt-% to about 20.0 wt-% of at least one detergent builder selected from tripolyphosphates; salts of alkali metal borates, phosphates, carbonates and bicarbonates; and mixtures thereof;

(b) from about 0.1 wt-% to about 5 wt-% of at least one thickening agent effective to provide increased viscosity;

(c) from about 0.1 wt-% to about 3.0 wt-% of an alkali metal hydroxide to provide a pH of about 10 to about 14;

(d) from about 0.5 wt-% to about 5.0 wt-% of an anionic surfactant to provide detergency to the composition;

(e) from about 0.0 wt-% to about 2.0 wt-% of a metal ion chelator;

(f) an optional dye; and (g) water.

30. The composition of claim 29, wherein said composition consists essentially of:

(a) from about 3.0 wt-% to about 13.0 wt-% of at least one detergent builder selected from tripolyphosphates;

(b) from about 0.1 wt-% to about 5 wt-% of at least one thickening agent comprising one or more polycarboxylate polymers;

(c) from about 0.1 wt-% to about 3.0 wt-% of an alkali metal hydroxide to provide a pH of about 10 to about 14;

(d) from about 0.5 wt-% to about 5.0 wt-% of an anionic surfactant comprising an alkyl sulfate, an alkyl aryl sulfonate, or a mixture thereof;

(e) from about 0.0 wt-% to about 2.0 wt-% of a metal ion chelator;

(f) an optional dye; and (g) water.

31. The composition of claim 29, wherein said composition consists essentially of:

(a) from about 3.0 wt-% to about 13.0 wt-% of at least one detergent builder selected from tripolyphosphates;

(b) from about 0.1 wt-% to about 5 wt-% of at least one thickening agent comprising a mixture of (i) one or more polycarboxylate polymers, and (ii) a xantham gum;

(c) from about 0.1 wt-% to about 3.0 wt-% of an alkali metal hydroxide to provide a pH of about 10 to about 14;

(d) from about 0.5 wt-% to about 5.0 wt-% of an anionic surfactant comprising an alkyl sulfate, an alkyl aryl sulfonate, or a mixture thereof;

(e) from about 0.0 wt-% to about 2.0 wt-% of a metal ion chelator;

(f) an optional dye; and (g) water.

32. The method of claim 13, wherein said composition consists essentially of:

(a) from about 3.0 wt-% to about 13.0 wt-% of at least one detergent builder selected from tripolyphosphates;

(b) from about 0.1 wt-% to about 5 wt-% of at least one thickening agent comprising one or more polycarboxylate polymers;

(c) from about 0.1 wt-% to about 3.0 wt-% of an alkali metal hydroxide to provide a pH of about 10 to about 14;

(d) from about 0.5 wt-% to about 5.0 wt-% of an anionic surfactant comprising an alkyl sulfate, an alkyl aryl sulfonate, or a mixture thereof;

(e) from about 0.0 wt-% to about 2.0 wt-% of a metal ion chelator;

(f) an optional dye; and (g) water.

33. The method of claim 32, wherein said composition consists essentially of:

(a) from about 3.0 wt-% to about 13.0 wt-% of at least one detergent builder selected from tripolyphosphates;

(b) from about 0.1 wt-% to about 5 wt-% of at least one thickening agent comprising a mixture of (i) one or more polycarboxylate polymers, and (ii) a xantham gum;

(c) from about 0.1 wt-% to about 3.0 wt-% of an alkali metal hydroxide to provide a pH of about 10 to about 14;

(d) from about 0.5 wt-% to about 5.0 wt-% of an anionic surfactant comprising an alkyl sulfate, an alkyl aryl sulfonate, or a mixture thereof;

(e) from about 0.0 wt-% to about 2.0 wt-% of a metal ion chelator;

(f) an optional dye; and (g) water.

34. A sprayable thickened hard surface cleaning composition comprising:

(a) from about 0.1 wt-% to about 20.0 wt-% of at least one detergent builder selected from tripolyphosphates; salts of alkali metal borates, phosphates, carbonates and bicarbonates; and mixtures thereof;

(b) from about 0.1 wt-% to about 5 wt-% of at least one thickening agent effective to provide increased viscosity, said at least one thickening agent comprising a xantham gum;

(c) from about 0.1 wt-% to about 3.0 wt-% of an alkali metal hydroxide to provide a pH of about 10 to about 14;

(d) from about 0.5 wt-% to about 5.0 wt-% of an anionic surfactant to provide detergency to the composition;

(e) from about 0.0 wt-% to about 5 wt-% of a fatty acid stabilizer effective to maintain a homogenous mixture of said at least one detergent builder, at least one thickening agent, and alkali metal hydroxide;

(f) from about 0.0 wt-% to about 2.0 wt-% of a metal ion chelator; and (g) water;

wherein said composition is substantially free of chlorine.

35. The composition of claim 34, wherein said at least one thickening agent further comprises one or more polycarboxylate polymers.

* * * * *